US008671520B2

(12) United States Patent
Tanno et al.

(10) Patent No.: US 8,671,520 B2
(45) Date of Patent: Mar. 18, 2014

(54) SLIDE ASSIST DEVICE

(75) Inventors: Akihiko Tanno, Fujisawa (JP); Kazuyuki Tomioka, Kanagawa (JP)

(73) Assignee: Nifco Inc., Yokohama-shi (JP)

( * ) Notice: Subject to any disclaimer, the term of this patent is extended or adjusted under 35 U.S.C. 154(b) by 0 days.

(21) Appl. No.: 13/634,115

(22) PCT Filed: Mar. 17, 2011

(86) PCT No.: PCT/JP2011/056353

§ 371 (c)(1), (2), (4) Date: Oct. 1, 2012

(87) PCT Pub. No.: WO2011/115198

PCT Pub. Date: Sep. 22, 2011

(65) Prior Publication Data

US 2013/0019438 A1 Jan. 24, 2013

(30) Foreign Application Priority Data

Mar. 17, 2010 (JP) ..... 2010-060234

(51) Int. Cl.

| | |
|---|---|
| ***E05F 3/00*** | (2006.01) |
| ***A47B 95/00*** | (2006.01) |
| ***A47B 88/04*** | (2006.01) |
| ***E05F 1/00*** | (2006.01) |

(52) U.S. Cl.

USPC ..... 16/49; 16/82; 312/333; 312/319.1

(58) Field of Classification Search

USPC ..... 16/49, 82, 85, 71, 78, 61, 63; 312/333, 312/319.1; 49/404, 138

See application file for complete search history.

(56) References Cited

U.S. PATENT DOCUMENTS

| | | | | |
|---|---|---|---|---|
| 1,174,210 | A | * | 3/1916 | Wexler |
| 2,601,604 | A | * | 6/1952 | Ford |
| 2,882,112 | A | * | 4/1959 | Jarvi |
| 3,358,318 | A | * | 12/1967 | Ingham |

(Continued)

FOREIGN PATENT DOCUMENTS

| | | |
|---|---|---|
| JP | 2008-110632 | 5/2008 |
| JP | 2008-144567 | 6/2008 |

(Continued)

OTHER PUBLICATIONS

JP 2009293323—Machine Translation.*

*Primary Examiner* — Victor Batson
*Assistant Examiner* — Jason W San
(74) *Attorney, Agent, or Firm* — Manabu Kanesaka

(57) ABSTRACT

A slide assist device includes a draw-in unit including a case attached to one of a main body or a mobile body, a slider slidably placed on the case, a latch pivotally supported in the slider and switchable between a standby position locking in a corresponding portion of the case and a draw-in position releasing the locking; and an urging device; and an actuating member attached to the other of the main body or the mobile body, switching the latch from the standby position to the draw-in position, or from the draw-in position to the standby position. The latch includes an axis portion having a flat surface and rotatably fits in an axis hole of the slider and forming a positional control surface corresponding to the flat surface. When the latch is switched to the standby position, the flat surface and the positional control surface face each other.

9 Claims, 13 Drawing Sheets

(56) References Cited

U.S. PATENT DOCUMENTS

| | | | | |
|---|---|---|---|---|
| 3,637,247 | A * | 1/1972 | Manion | |
| 4,656,781 | A * | 4/1987 | Niekrasz et al. | |
| 4,675,938 | A * | 6/1987 | Bundschuh | |
| 5,302,016 | A * | 4/1994 | Lautenschlager et al. | |
| 5,474,375 | A * | 12/1995 | Hollenstein et al. | |
| 5,517,719 | A * | 5/1996 | Christ | |
| 5,529,148 | A * | 6/1996 | O'Leary | |
| 5,580,138 | A * | 12/1996 | Grabher | |
| 5,832,562 | A * | 11/1998 | Luca | |
| 5,842,255 | A * | 12/1998 | Luca | 16/51 |
| 5,967,587 | A * | 10/1999 | Collet et al. | 296/97.11 |
| 6,151,753 | A * | 11/2000 | Salutzki | 16/62 |
| 6,848,759 | B2 * | 2/2005 | Doornbos et al. | 312/319.1 |
| 6,928,700 | B2 * | 8/2005 | Huong | 16/342 |
| 6,971,729 | B1 * | 12/2005 | Kim et al. | 312/319.1 |
| 7,240,978 | B2 * | 7/2007 | Kobayashi et al. | 312/333 |
| 7,281,773 | B2 * | 10/2007 | Sato et al. | 312/333 |
| 7,356,878 | B2 * | 4/2008 | Foster | 16/71 |
| 7,393,068 | B2 * | 7/2008 | Sato et al. | 312/333 |
| 7,708,357 | B2 * | 5/2010 | Cho | 312/333 |
| 7,740,327 | B2 * | 6/2010 | Hsieh | 312/333 |
| 7,743,464 | B2 * | 6/2010 | Tomioka et al. | 16/64 |
| 7,748,800 | B2 * | 7/2010 | Compagnucci | 312/333 |
| 7,815,267 | B1 * | 10/2010 | Frousiakis | 312/333 |
| 7,845,744 | B2 * | 12/2010 | Chen et al. | 312/334.6 |
| 7,854,485 | B2 * | 12/2010 | Berger | 312/333 |
| 7,878,606 | B2 * | 2/2011 | Chen et al. | 312/333 |
| 8,060,983 | B2 * | 11/2011 | Bortoluzzi | 16/85 |
| 8,079,653 | B2 * | 12/2011 | Huang | 312/333 |
| 8,083,304 | B2 * | 12/2011 | Hu | 312/333 |
| 8,182,054 | B2 * | 5/2012 | Liang et al. | 312/333 |
| 8,205,951 | B2 * | 6/2012 | Boks | 312/319.1 |
| 8,235,478 | B2 * | 8/2012 | Zimmer et al. | 312/333 |
| 8,240,787 | B2 * | 8/2012 | Chen et al. | 312/333 |
| 8,307,497 | B2 * | 11/2012 | Chang et al. | 16/71 |
| 8,402,606 | B1 * | 3/2013 | Tsai | 16/49 |
| 2006/0272129 | A1 * | 12/2006 | Rude et al. | 16/342 |
| 2007/0067950 | A1 * | 3/2007 | Johnson | 16/63 |
| 2008/0099647 | A1 | 5/2008 | Shimozaki | |
| 2008/0265587 | A1 * | 10/2008 | Nakanishi et al. | 292/26 |
| 2008/0284299 | A1 * | 11/2008 | Chen et al. | 312/332 |
| 2009/0045710 | A1 * | 2/2009 | Compagnucci | 312/333 |
| 2010/0026152 | A1 * | 2/2010 | Huang | 312/319.1 |
| 2010/0031469 | A1 * | 2/2010 | Chiang | 16/64 |
| 2010/0043172 | A1 * | 2/2010 | Nezu et al. | 16/71 |
| 2010/0123378 | A1 * | 5/2010 | Chen et al. | 312/333 |
| 2011/0115353 | A1 * | 5/2011 | Domenig et al. | 312/333 |
| 2011/0210653 | A1 * | 9/2011 | Salice | 312/319.1 |
| 2011/0215690 | A1 * | 9/2011 | Juan et al. | 312/319.1 |
| 2011/0254416 | A1 * | 10/2011 | Salice | 312/319.1 |
| 2011/0271482 | A1 * | 11/2011 | Nezu | 16/49 |
| 2012/0062088 | A1 * | 3/2012 | Chen et al. | 312/319.1 |
| 2012/0124778 | A1 * | 5/2012 | Sato | 16/94 R |
| 2012/0204380 | A1 * | 8/2012 | Chen | 16/342 |
| 2012/0311817 | A1 * | 12/2012 | Bacchetti | 16/51 |
| 2013/0014343 | A1 * | 1/2013 | Tanno et al. | 16/49 |
| 2013/0019438 | A1 * | 1/2013 | Tanno et al. | 16/94 R |
| 2013/0069514 | A1 * | 3/2013 | Hashemi et al. | 312/333 |
| 2013/0076218 | A1 * | 3/2013 | Radusin | 312/319.1 |
| 2013/0076219 | A1 * | 3/2013 | Lam et al. | 312/319.1 |
| 2013/0134852 | A1 * | 5/2013 | Salice | 312/319.1 |

FOREIGN PATENT DOCUMENTS

| | | | |
|---|---|---|---|
| JP | 2009-293323 | | 12/2009 |
| JP | 2009293323 | A * | 12/2009 |
| JP | 2012167540 | A * | 9/2012 |
| WO | WO 2009148151 | A1 * | 12/2009 |
| WO | WO 2010150863 | A1 * | 12/2010 |

* cited by examiner (Open state or Stand by position)

(Open state or Stand by position)

(When switching toward closing direction or Draw-in Position)

(When switching toward closing direction or Draw-in Position)

SLIDE ASSIST DEVICE

RELATED APPLICATIONS

The present application is National Phase of International Application No. PCT/JP2011/056353 filed Mar. 17, 2011, and claims priority from Japanese Application No. 2010-060234 filed Mar. 17, 2010, the disclosure of which is hereby incorporated by reference herein in its entirety.

FIELD OF TECHNOLOGY

The present invention relates to a slide assist device which assists an operation switching a mobile body such as a sliding door, a door, and the like from a first position on a main body side to a second position, or an operation switching the mobile body from the second position to the first position, by an urging force.

BACKGROUND ART

FIGS. 12(*a*) and 12(*b*) show a slide assist device of the following Patent Document 1. Characteristics of the device are that a main body frame slidably disposes the sliding door or the door; a projecting body 9 which is an actuating member is provided in the sliding door or the door; and the sliding door or the door is drawn in through the projecting body 9 by a draw-in unit which is a main portion of the slide assist device provided in the main body frame. The draw-in unit comprises a case 1 attached to the main body frame; sliders 2A and 2B slidably placed on the case 1; latches 5 and 5 pivotally supported relative to each slider through a shaft 8; and an urging device 3. The projecting body 9 is provided to protrude on an upper end surface side of the sliding door or the door.

There, the case 1 is formed slenderly and also thinly because the case 1 is disposed along a guiding groove of the main body frame. Each slider 2A and 2B includes a convex portion 22 provided on upper and lower surfaces. Each convex portion 22 fits into guide grooves 12*b* and 16*b* provided on the upper and lower surfaces of the case 1, and each convex portion is slid while being guided by the upper and lower guide devices. Also, each latch 5 includes a protrusion 52 provided on the upper and lower surfaces. The respective protrusions 52 fit into guide grooves 14 and 19 provided on the upper and lower surfaces of the case 1, and the respective protrusions 52 slide while being guided by the upper and lower guide devices. The respective guide grooves 14 and 19 include straight grooves 14*a* and 19*a* parallel to the guide grooves 12*b* and 16*b*, and locking grooves 14*b* and 19*b* with an approximately L shape provided on both sides of the straight grooves 14*a* and 19*a*.

In the above-mentioned slide assist device, the latches 5 on both sides in FIG. 12(*a*) and the latch 5 on the right side in FIG. 12(*b*) are in a standby position. In the latches 5, in the standby position, the upper and lower protrusions 52 are locked in the corresponding locking grooves 14*b* and 19*b*, and positions of the latches 5 are controlled against an urging force accumulated in the urging device 3 together with the slider 2A. Then, from a state shown in FIG. 12(*a*), when the sliding door or the door which is in an open position on the left side (not shown in the figure) is operated to slide in a closing direction from the open position, the projecting body 9 hits against an inner surface of a hook portion 50 of the corresponding latch 5 of the draw-in unit, and the latch 5 is rotated by the force thereof, and is switched to a draw-in position as shown on the left side of FIG. 12(*b*) from the standby position. In the draw-in position, in a state wherein the latch 5 has constrained the projecting body 9 inside the hook portion, the upper and lower protrusions 52 enter into the straight grooves 14*a* and 19*a* from the locking grooves 14*b* and 19*b* so as to release the locking. Consequently, the latch 5 and the slider 2A are slid by the urging force accumulated in the urging device 3, and automatically switch the sliding door or the door to a closed position through the projecting body 9. Also, from the closed position, by an opening operation of the sliding door or the door, when the projecting body 9 is slid to the left side of the figure together with the latch 5, accompanied by that, the urging force is accumulated in the urging device 3. Moreover, when the sliding door or the door is moved in an open direction, the latch 5 is switched to the standby position again.

PRIOR ART DOCUMENT

Patent Document

Patent Document 1: Japanese Unexamined Patent Publication No. 2008-144567

SUMMARY OF THE INVENTION

Problems to be Solved by the Invention

In the aforementioned slide assist device, for example, when the sliding door or the door is operated to be closed, the sliding door or the door is automatically switched up to the closed position by the urging force during the middle of the closing operation so as to improve usability of the sliding door or the door, and to be capable of solving an occurrence of an incomplete closed state of the sliding door or the door.

As for the slide assist device, however, for example, as with a slide assist mechanism (described in Japanese Unexamined Patent Publication No. 2011-006872 and the like) in which the present applicants have developed previously, on the assumption that the slider is slid in a longitudinal direction inside the case as much as possible, especially, a stable switching actuation from the draw-in position to the standby position of the latch is important, i.e., it is important that the protrusion on a latch side enters into the locking groove from the straight groove on a guide groove side so as to lock the latch, and that the locking cannot be unlocked abruptly by a vibration, an impact, and the like.

Also, as for the urging device, it is preferable that a coil spring whose entire size is long is used, and also that a sliding speed of the slider is controlled by a braking device. As for the braking device, in a case where a piston-type braking device with an excellent braking property is used, structural members (a cylinder and a piston rod) of the braking device thereof have to be fixed to the slider or the case. However, a fixation structure of, especially, the piston rod, which becomes a small diameter, becomes a problem.

Means for Solving the Problems

In order to achieve the aforementioned object, the present invention provides a slide assist device having characteristics of either of the following (1) to (4).

(1) The slide assist device comprises a draw-in unit including a case attached to one of a main body or a mobile body, a slider slidably placed on the case, a latch pivotally supported in the slider, and capable of switching between a standby position locking in a corresponding portion of the case and a draw-in position releasing the aforementioned locking, and an urging device; and an actuating member attached to the other of the main body or the mobile body, and switching the latch from the standby position to the draw-in position, or switching the latch from the draw-in position to the standby position. When the latch switches from the standby position to the draw-in position, an urging force accumulated in the urging device moves the mobile body from a first position on a main body side to a second position through the actuating member. In the slide assist device, the latch includes an axis portion provided with a flat surface along an axis direction, and the axis portion turnably fits in an axis hole provided in the slider and having a positional control surface corresponding to the aforementioned flat surface. When the latch is switched to the standby position, the flat surface and the positional control surface face each other.

(2) Also, the slide assist device comprises a draw-in unit including a case attached to one of the main body or the mobile body, a slider slidably placed on the case, a latch pivotally supported in the slider, and capable of switching between the standby position locking in the corresponding portion of the case and the draw-in position releasing the aforementioned locking, and an urging device; and an actuating member attached to the other of the main body or the mobile body, and switching the latch from the standby position to the draw-in position, or switching the latch from the draw-in position to the standby position. When the latch is switched from the standby position to the draw-in position, the urging force accumulated in the urging device moves the mobile body from the first position on the main body side to the second position through the actuating member. The slide assist device comprises a resistance-imparting portion provided on a sliding-and-contacting surface between the latch and the slider, and acting as a resistance or a friction force when the latch is turned as a supporting point of a pivotal support portion relative to the slider.

(3) Also, in the slide assist device of the aforementioned (2), the resistance-imparting portion has a structure including a convex portion or a concave-convex portion provided on at least one sliding-and-contacting surface of the latch or the slider.

(4) Also, the slide assist device includes a piston-type braking device 5 damping a moving speed from the urging force of the mobile body, a temporary fixing member provided in the slider or the case to temporarily fix structural members of the braking device; and an attachment member firmly fixing the structural members of the braking device by being engaged with the slider or the case.

Incidentally, the slide assist device is preferred for a fixation structure of especially, a piston rod, which becomes a small diameter, among the structural members of the piston-type braking device. From a state wherein the piston rod is temporarily fixed once, the slide assist device firmly fixes the piston rod by an engaging operation of the attachment member relative to the slider or the case.

Incidentally, as for the above-mentioned mobile body, there also include, for example, a drawer and the like other than a sliding door or a door. Also, as for the main body, there also include a frame for the sliding door or the door, a storage portion for the drawer, and the like. Also, the first position shows a completely closed position or a completely open position of the mobile body, and also includes a closed position wherein the mobile body has been completely pushed into the storage portion, or an open position wherein the mobile body has been completely pulled out. Also, the second position shows a completely open position or a completely closed position of the mobile body, and also includes an open position wherein the mobile body has been completely pulled out of the storage portion, or a closed position wherein the mobile body has been completely pushed in.

Effect of the Invention

In the slide assist device having the characteristic of the aforementioned (1), an outer shape of a cross-section of the axis portion and the axis hole is not a complete circular form, and has a shape including a straight portion in which one portion of a circular arc has been cut out (i.e., a shape close to an alphabet "D"), so that the axis portion has the flat surface in one portion of a side surface thereof, and the axis hole also has the flat surface in one portion of an inner surface thereof. Then, when the latch is in the standby position, a fitted state between the axis portion and the axis hole becomes the most stable fitted state wherein the aforementioned flat surface of the axis portion and the flat surface of the axis hole face approximately in parallel. Namely, in the slide assist device of the aforementioned (1), since the latch is structured so as to increase the resistance when the latch turns from the standby position, the slide assist device can prevent the latch from turning by a vibration, an impact, and the like from an outside. Also, in the slide assist device of the aforementioned (1), the shape of the cross-section of the axis portion and the axis hole has the above-mentioned shape, so that when the latch is switched from the standby position to the draw-in position by the actuating member, the latch is turned at a slow speed so as to be capable of reducing an emanating switchover sound.

In the slide assist device having the characteristic of the aforementioned (2), when the latch is turned as the supporting point of the pivotal support portion, the latch receives a resisting force by the resistance-imparting portion, so that the latch cannot be easily turned due to the vibration, the impact, and the like from the outside so as to be capable of preventing a mis-actuation. Also, in the slide assist device having the characteristic of the aforementioned (2), by further including the characteristic of (3), the resistance-imparting portion can be easily added so as to be capable of improving an actuation property.

In the slide assist device having the characteristic of the aforementioned (4), in a case where the actuation property is attempted to be improved by the piston-type braking device, the structural members of the braking device thereof have to be fixed to the slider or the case. However, the slide assist device can easily come out since the slide assist device becomes smaller due to a usage constraint. Accordingly, the slide assist device has been devised. In the structure, the slide assist device is preferred when, especially, the piston rod with the small diameter is fixed. From the state wherein the piston rod is temporarily fixed once, the piston rod is firmly fixed by the engaging operation of the attachment member relative to the slider or the case so as to have an excellent operability.

BRIEF DESCRIPTION OF THE DRAWINGS

FIG. 1(*b*) is a right end face view of the draw-in unit 6 in the state wherein the cover 15 is removed from the case 1.

FIG. 1(*c*) is a drawing showing an inner surface of the cover 15.

FIG. 2(*b*) is a cross-sectional view in a cross-section taken along a line B to B in FIG. 1(*a*).

FIG. 2(*c*) is a cross-sectional view in a cross-section taken along a line C to C in FIG. 1(*a*).

FIG. 3(*b*) is a schematic view wherein the inside of the frame shown by assigning the reference alphabet "D" in FIG. 1(*a*) is enlarged, and shows a draw-in position of the latch 4.

FIG. 3(*c*) is a cross-sectional view in a cross-section taken along a line E to E in FIG. 3(*a*).

FIG. 5(*b*) is a bottom view of the slider 2A on the left side of FIG. 1(*a*).

FIG. 6(*b*) is a bottom view of the slider 2B on the right side of FIG. 1(*a*).

FIG. 7(*b*) is a plan view of a connecting portion 21 in a state wherein an attachment member 29 is removed.

FIG. 9(*b*) is a bottom view of the latch 4 in the draw-in unit 6.

FIG. 9(*c*) is a front view of the latch 4 in the draw-in unit 6.

FIG. 10(*b*) is a schematic view showing the latch 4 and the surrounding portion thereof when the latch 4 is in the standby position.

FIG. 10(*c*) is a schematic view showing the latch 4 and the surrounding portion thereof when the latch 4 is switched from the standby position to the draw-in position.

FIG. 10(*d*) is a pattern diagram showing a process wherein an urging force is being accumulated in a coil spring 3.

FIG. 11(*b*) is a drawing showing a state wherein the slide assist device according to the present embodiment is applied to the main body 7 and the sliding portion of the door A (the mobile body).

FIG. 11(*c*) is a perspective view showing a structural example of a projecting body 8 (an actuating member).

FIG. 12(*b*) is a substantial operational view of the draw-in unit in the slide assist device of the Patent Document 1.

BEST MODES OF CARRYING OUT THE INVENTION

Hereinafter, a slide assist device according to embodiments of the present invention will be explained with reference to the drawings in order of device characteristics, a draw-in unit, an actuating member, an assembly, an actuation, and a modified example.

Figure 1A:
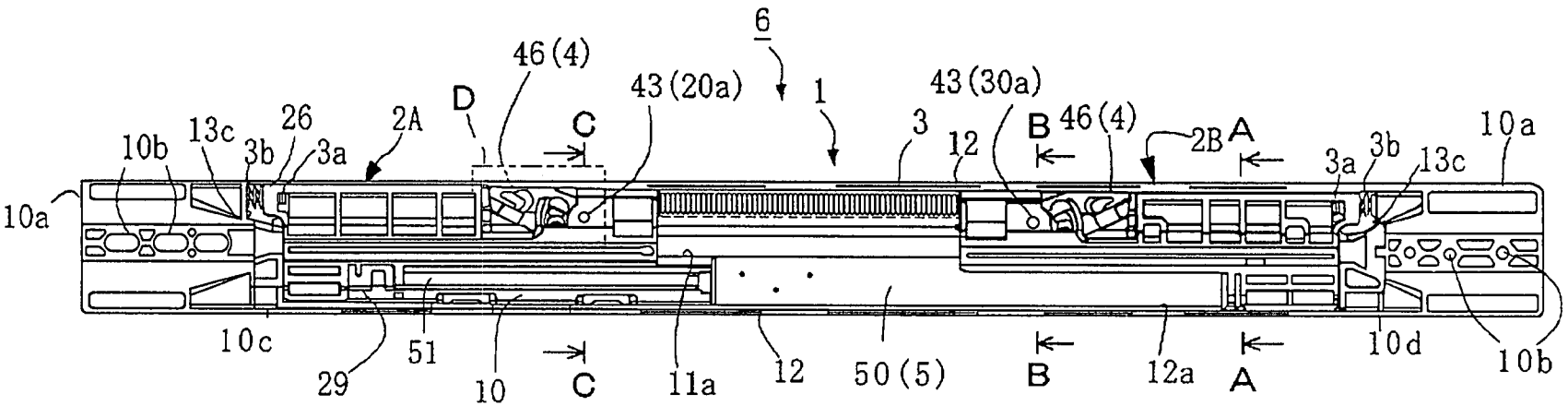
FIG. 1(*a*) is a plan view showing a state wherein a cover 15 is removed from a case 1 structuring a draw-in unit 6 of a slide assist device according to an embodiment of the present invention.
Figure 1C:
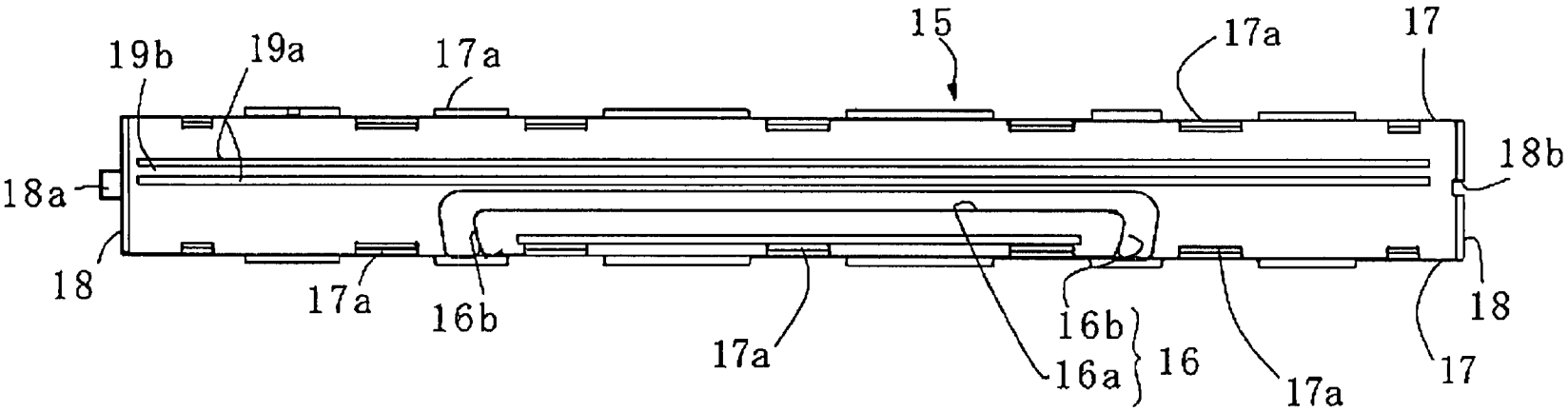
Figure 1B:
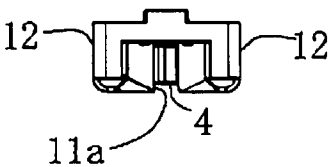
Figure 2A:
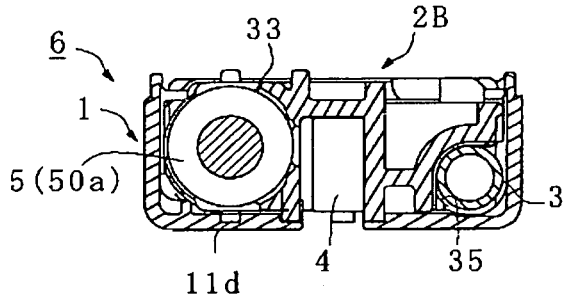
FIG. 2(*a*) is a cross-sectional view in a cross-section taken along a line A to A in FIG. 1(*a*).
Figure 2B:
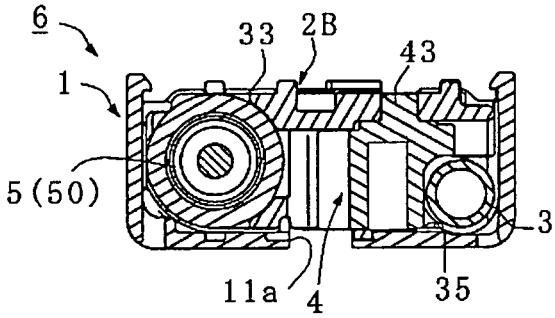
Figure 2C:
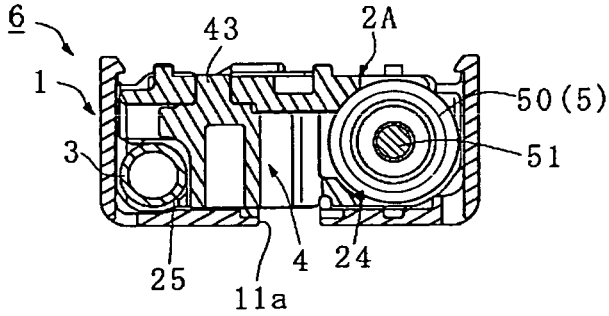

FIG. 1(*a*) is a plan view showing a state wherein a cover 15 is removed from a case 1 structuring a draw-in unit 6 of a slide assist device according to an embodiment of the present invention. Also, FIG. 1(*b*) is a right end face view of the draw-in unit 6 in the state wherein the cover 15 is removed from the case 1. Also, FIG. 1(*c*) is a drawing showing an inner surface of the cover 15. Also, FIG. 2(*a*) is a cross-sectional view in a cross-section taken along a line A to A in FIG. 1(*a*). Also, FIG. 2(*b*) is a cross-sectional view in a cross-section taken along a line B to B in FIG. 1(*a*). Also, FIG. 2(*c*) is a cross-sectional view in a cross-section taken along a line C to C in FIG. 1(*a*). Also, FIG. 3(*a*) is a schematic view wherein an inside of a frame shown by assigning the reference alphabet "D" in FIG. 1(*a*) is enlarged, and shows a standby position of a latch 4. Also, FIG. 3(*b*) is a schematic view wherein the inside of the frame shown by assigning the reference alphabet "D" in FIG. 1(*a*) is enlarged, and shows a draw-in position of the latch 4. Also, FIG. 3(*c*) is a cross-sectional view in a cross-section taken along a line E to E in FIG. 3(*a*).

Figure 4:
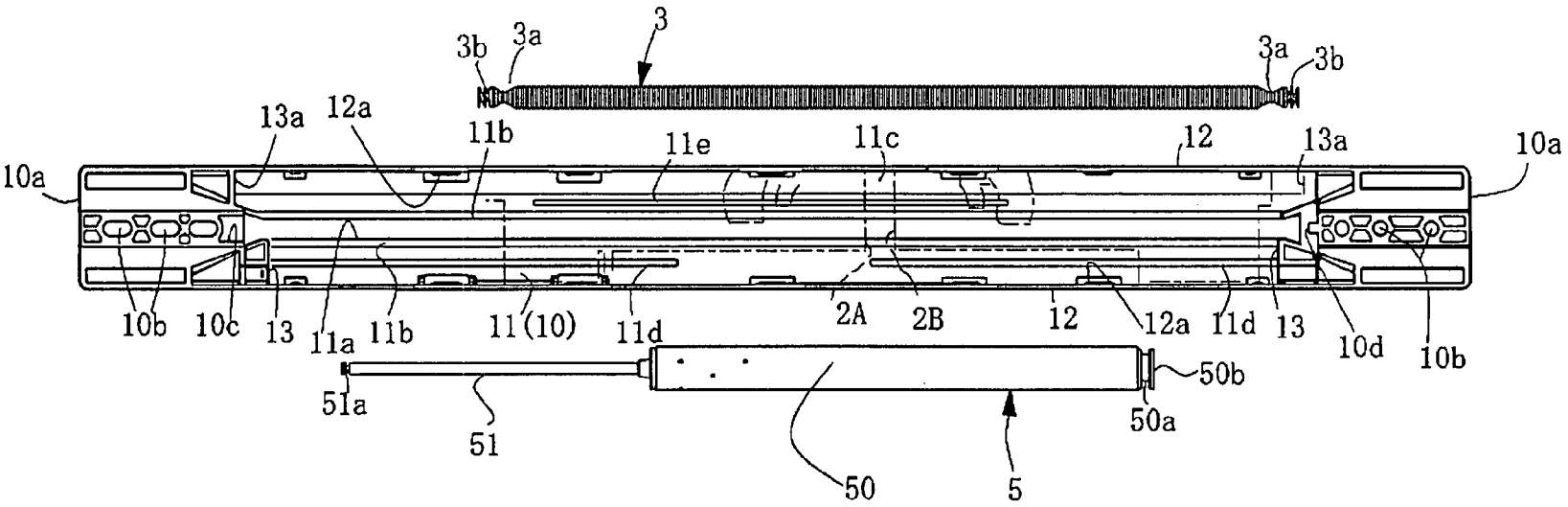
FIG. 4 is a plan view showing the case 1 without the cover 15 together with an urging device and a braking device.
Figure 5A:
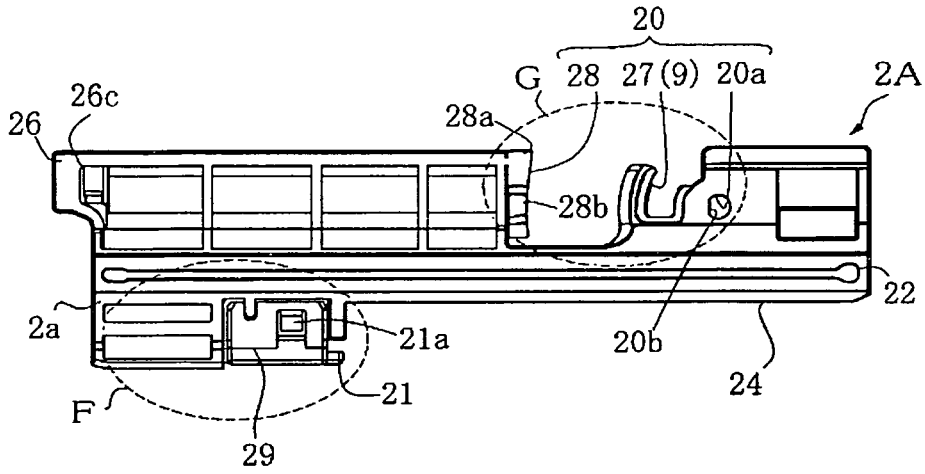
FIG. 5(*a*) is a plan view of a slider 2A on the left side of FIG. 1(*a*).
Figure 5B:
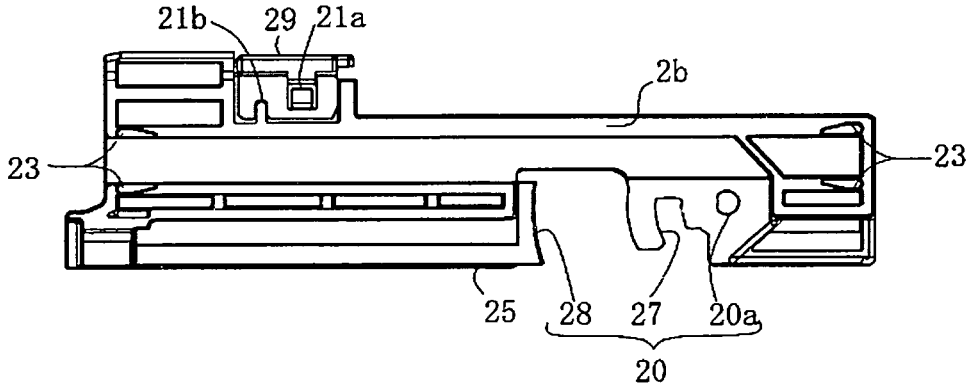
Figure 6A:
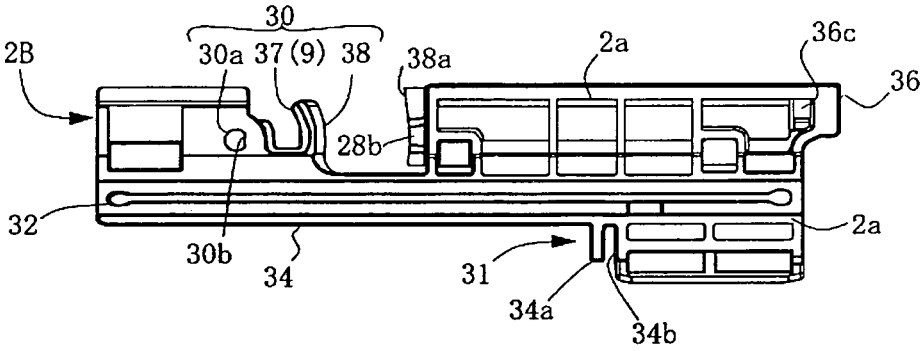
FIG. 6(*a*) is a plan view of a slider 2B on the right side of FIG. 1(*a*).
Figure 6B:
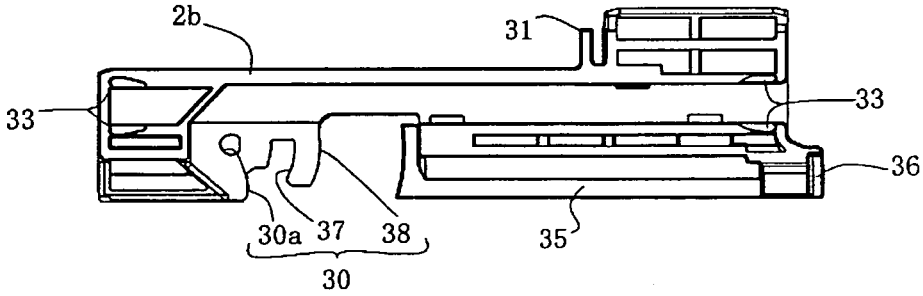

Also, FIG. 4 is a plan view showing the case 1 without the cover 15 together with an urging device and a braking device. Also, FIG. 5(*a*) is a plan view of a slider 2A on the left side of FIG. 1(*a*). Also, FIG. 5(*b*) is a bottom view of the slider 2A on the left side of FIG. 1(*a*). Also, FIG. 6(*a*) is a plan view of a slider 2B on the right side of FIG. 1(*a*). Also, FIG. 6(*b*) is a bottom view of the slider 2B on the right side of FIG. 1(*a*). Also, FIG. 7(*a*) is a drawing showing a structure inside a frame shown by assigning the reference alphabet "F" in FIG. 5(*a*). Also, FIG. 7(*b*) is a plan view of a connecting portion 21 in a state wherein an attachment member 29 is removed. Also, FIG. 8 is a drawing showing a structure inside a frame shown by assigning the reference alphabet "G" in FIG. 5(*a*). Also, FIG. 9(*a*) is a plan view of the latch 4 of the draw-in unit 6. Also, FIG. 9(*b*) is a bottom view of the latch 4 in the draw-in unit 6. Also, FIG. 9(*c*) is a front view of the latch 4 in the draw-in unit 6.

Also, FIG. 10(*a*) is a schematic view showing the latch 4 and a surrounding portion thereof when the latch 4 is in the standby position. Also, FIG. 10(*b*) is a schematic view showing the latch 4 and the surrounding portion thereof when the latch 4 is in the standby position. Also, FIG. 10(*c*) is a schematic view showing the latch 4 and the surrounding portion thereof when the latch 4 is switched from the standby position to the draw-in position. Also, FIG. 10(*d*) is a pattern diagram showing a process wherein an urging force is being accumulated in a coil spring 3. Also, FIG. 11(*a*) is a drawing showing a condition wherein the slide assist device according to the present embodiment is applied to a main body 7 and a sliding portion of a door A (a mobile body). Also, FIG. 11(*b*) is a drawing showing a condition wherein the slide assist device according to the present embodiment is applied to the main body 7 and the sliding portion of the door A (the mobile body). Also, FIG. 11(*c*) is a perspective view showing a structural example of a projecting body 8 (an actuating member).

(Device Characteristics)

The slide assist device according to the present embodiment comprises the draw-in unit 6 attached to one of the main body 7 or the mobile body (hereinafter, explained in an example of the door A) such as a sliding door, a door, and the like; and the projecting body 8 attached to the other of the main body 7 or the door A. Incidentally, the door A is one example of the mobile body which is an attachment object of the slide assist device, and the projecting body 8 is one example of the actuating member in the present invention. Also, in the present example, a case, where the draw-in unit 6 is attached to the main body 7, and where the projecting body 8 is attached to the door A, is shown; however, the draw-in unit 6 can be attached to the door A, and also the projecting body 8 can be attached to the main body V. Also, a structure of the draw-in unit 6 and the projecting body 8 is broadly divided into the following three types by an attached mobile body or a draw-in actuation setup.

The first structure is a case where the draw-in unit 6 and two projecting bodies 8 as a pair are used. The draw-in unit 6 disposes a pair of the sliders 2A and 2B which is slid in a moving direction toward and away from each other relative to the case 1; the coil spring 3 urging in a direction of moving both the sliders 2A and 2B close to each other; a braking device 5 putting a brake on a sliding speed of the sliders 2A and 2B; and a pair of the latches 4 rotatably supported respectively in each slider 2A and 2B, and releasably locked in a corresponding portion inside the case 1 so as to be capable of holding both the sliders 2A and 2B in a separated state. Incidentally, the coil spring 3 is one example of the urging device in the present invention.

A second structure is a case wherein as the mobile body, for example, the double-door-type door (the sliding door) A and a door B respectively slide relative to a corresponding opening portion of the main body 7. Structural members of the draw-in unit 6 corresponding to one door A and the draw-in unit 6 corresponding to the other door B are embedded in the common case 1. Namely, in the draw-in unit 6, there is a unit of the right-and-left sliders 2A and 2B which are slid in the direction of moving toward and away from each other; the coil spring 3 urging both the sliders 2A and 2B in the direction of moving close to each other; and a pair of the latches 4 pivotally supported respectively in each slider 2A and 2B, and also releasably locked in a case 1 side so as to be capable of holding both the sliders 2A and 2B in the separated state. The draw-in unit 6 has the structure wherein two pairs of the above are disposed relative to the same case 1. Since an explanation of the above can be easily inferred from the following embodiment, the explanation is omitted.

A third structure is a case where the mobile body is drawn in only in one direction. The draw-in unit 6 is the most simplified structure in which one of the sliders 2A and 2B in FIG. 1(*a*) is omitted, one end of the coil spring 3 is locked in the slider, and also the other end is locked in a case side, and as necessary, one end of the braking device 5 is locked in the slider, and also the other end is locked in the case 1 side. Since an explanation of the above can be easily inferred from the following embodiment, the explanation is also omitted.

(Draw-In Unit)

The case 1 of the draw-in unit 6 is a slender part with an approximately cuboid shape, and includes an internal space 10 divided by a lower surface 11, both side surfaces 12, and right-and-left end portions 13*a*. On an upper side of the internal space 10, there is provided an opening. Also, the above-mentioned opening is covered by the cover 15. Also, on right and left of the internal space 10 in the case 1, there are provided attachment portions 10*a* for attaching the case 1 to the main body 7. Also, the end portions 13*a* divide the internal space 10 on an outer side than end portions 13 in a longitudinal direction of the case 1, and on an inner surface of the end portions 13*a*, there abut elongation portions 3*b* of the coil spring 3. On the lower surface 11, there are provided a guide hole 11*a* formed in an intermediate portion in a width direction along the longitudinal direction; and guide portions 11*b* formed one step lower than both edge portions of the guide hole 11*a*. A guide groove 11*c* is a shallow concave groove formed along an inner side of one side surface 12, and positions the sliders 2A and 2B, and one portion of the coil spring 3. Guide grooves 11*d* are concave portions which facilitate a cylinder 50 structuring a piston damper as the braking device 5 to slide inside the case 1. The reference numeral 11*e* represents a guide groove which fits into a convex portion 48 provided on a lower surface of the latch 4.

The cover 15 includes a slider guide groove 19*b* provided between a rib 19*a* and a rib 19*a* formed along the longitudinal direction in an intermediate portion in the width direction; and an approximately concave latch guide portion 16 provided in the middle of right and left. The guide portion 16 includes a straight groove 16*a* extending to the right and left, and locking grooves 16*b* with an approximately L shape provided on both sides of the straight groove 16*a*.

On both side surfaces 12 of the case 1 and both sides 17 on a cover side, there are provided hook-like locking portions 12*a* and concave engaging portions 17*a* mutually engaging when the cover 15 is disposed in the space portion 10 with a plurality of pairs. Also, in the attachment portions 10*a* on the case side and right-and-left end surfaces 18 on the cover side, there are provided a concave locking portion 10*c* and a convex engaging portion 18*a*, and a convex locking portion 10*d* and a concave engaging portion 18*b*, which mutually engage when the cover 15 is disposed in the space portion 10. Then, in the example, the cover 15 is placed in the case 1 through engagements of the above-mentioned portions. The right-and-left attachment portions 10*a* have a cross-section of an inverted concave shape in the width direction, and the projecting body 8 can slide along the guide hole 11*a* from an inverted concave portion thereof.

The sliders 2A and 2B have a block shape made of resin, and are disposed in a space between the lower surface 11 of the case 1 and the cover 15. In the example, as the braking device 5, since a piston-type damper is used, shapes of the sliders 2A and 2B differ. However, in such a case where a rotary damper is used as the braking device, the sliders 2A and 2B can also have the same shape.

The slider 2A and the slider 2B are common in the following respects. Connecting portions 21 and 31 for the braking device form one portion of an upper surface 2*a* and a lower surface 2*b*, and also include ribs 22 and 32 provided on the upper surface 2*a* and extending to right and left. Also, there include convex portions 23 and 33 provided in four corners of an approximately intermediate portion of the lower surface 2*b*. Also, there include guide portions 24 and 34 with an arc-like cross-section provided in parallel to one side, i.e., to the connecting portions 21 and 31, and guiding the braking device 5; and spring placement portions 25 and 35 provided along a longitudinal direction on a lower surface side on the other side. Also, there include concave engaging portions 26 and 36 provided on one end side of each spring placement portion 25 and 35, and locking corresponding end portions 3*a* of the coil spring 3. Also, there include latch placement portions 20 and 30 located on spring placement portions 25 and 35 sides, and formed in a concave shape in one portion on a lower side. Also, there include escape grooves 28 and 38, and support grooves 27 and 37, provided on an upper wall portion dividing each latch placement portion 20 and 30; and pivotally supporting axis holes 20*a* and 30*a*. Also, the engaging portion 26 of the slider 2A is an approximately short-formed wall surface vertically protruding relative to the spring placement portion 25. Also, the engaging portion 36 of the slider 2B is an approximately short-formed wall surface vertically protruding relative to the spring placement portion 35. The engaging portion 26 of the slider 2A and the engaging portion 36 of the slider 2B abut against the end portions 3*a* of the coil spring 3.

Figure 7A:
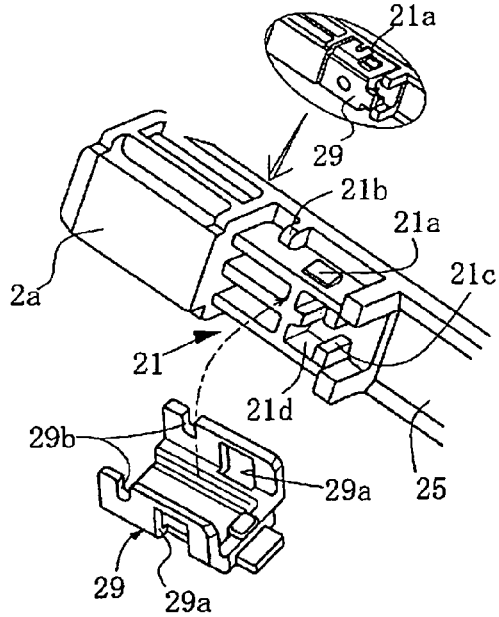
FIG. 7(*a*) is a drawing showing a structure inside a frame shown by assigning the reference alphabet "F" in FIG. 5(*a*).
Figure 7B:
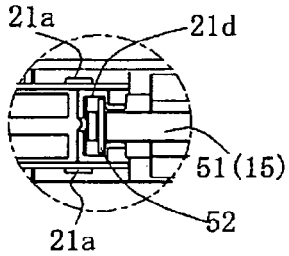
Figure 8:
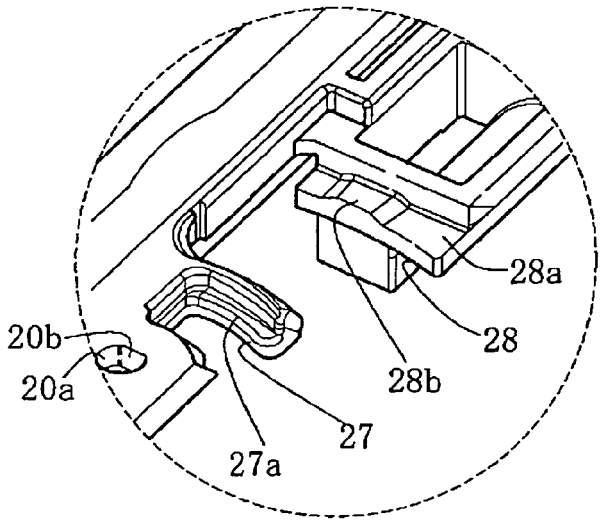
FIG. 8 is a drawing showing a structure inside a frame shown by assigning the reference alphabet "G" in FIG. 5(*a*).

Here, as shown in FIGS. 7(*a*) and 7(*b*), the connecting portion 21 includes claws 21*a* and positioning protrusions 21*b*, provided on both sides; a housing portion 21*d* including a window 21*c* opening in a horizontal direction; and the attachment member 29 which is placed in such a way as to cover the housing portion 21*d*. The attachment member 29 is structured by an approximately short-formed planar portion, and lateral face portions vertically extending relative to the planar portion from both sides of the planar portion. Then, on the aforementioned lateral face portions of the attachment member 29, there are formed engaging holes 29*a* engaging with the claws 21*a* of the connecting portion 21; and concave portions 29*b* engaging with the protrusions 21*b* of the connecting portion 21. Also, the connecting portion 31 of the slider 2B includes an approximately U-shaped clamp portion 34*a* provided by maintaining a gap 34*b* between an inner end surface and the clamp portion 34*a*.

In the latch placement portions 20 and 30 of the sliders 2A and 2B, the axis holes 20*a* and 30*a* are provided near end portions of the sliders 2A and 2B, and pass through in an up-and-down direction. A cross-sectional shape of the axis holes 20*a* and 30*a* has the approximately same shape as a cross-sectional shape of an axis portion 43 of the later-mentioned latch 4. Namely, as shown in FIG. 8, the cross-sectional shape of the axis holes 20*a* and 30*a* has a shape in which one portion of a circular form is notched. Therefore, although most of an inner surface of the axis holes 20*a* and 30*a* has an approximately cylindrical form, there is provided a planar portion as a positional control surface 20*b* in one portion thereof.

The support grooves 27 and 37 are located on a concentric circle as the axis holes 20*a* and 30*a*, are notched in an arc shape from one side, and also include step differences 27*a* and 37*a* which become receiving faces provided along an upper edge. The step differences 27*a* and 37*a* structure a control device 9, which maintains the latch 4 horizontally so that the latch 4 does not tilt up and down, together with a head portion 41*b* of a support axis 41 on the later-mentioned latch side.

The escape grooves 28 and 38 are located on a concentric circle as the axis holes 20*a* and 30*a*, are notched in an arc shape from one side in a state wherein a groove width is enlarged more than the aforementioned support axis, and include step differences 28*a* and 38*a* which become receiving faces provided along an outside upper edge which is separated from the support axis; and a resistance-imparting portion 28*b* provided on each step difference 27*a* and 37*a*. The step differences 28*a* and 38*a* receive an end portion 45 of the latch 4 from underneath in a state wherein the axis portion 43 of the later-mentioned latch 4 fits into the axis hole 20*a* or the axis hole 30*a* so as to be pivotally supported in the sliders 2A and 2B. The resistance-imparting portion 28*b* is a convex portion protruded on the step differences 28*a* and 38*a* thereof, and acts as a resistance (an increase portion) or a frictional force (the increase portion) when the latch 4 is turned as a supporting point of a pivotal support portion relative to the sliders 2A and 2B so as to stably hold the latch 4 in the standby position of FIG. 3(*a*), and to prevent a tracing protrusion 46 from being abruptly unlocked from the aforementioned locking groove 16*b*. Incidentally, the above-mentioned resistance-imparting portion 28*b* may be formed in a concave-convex portion other than the convex portion, and furthermore, the resistance-imparting portion 28*b* may be provided on a lower surface of an end of the latch 4 in place of an upper surface of the step differences 28*a* and 38*a*, or together with the upper surface of the step differences 28*a* and 38*a*.

Figure 9A:
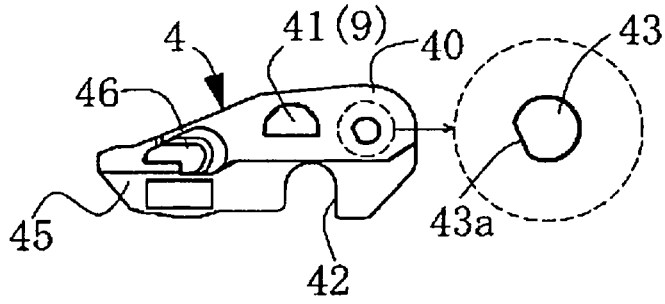
FIG. 9(*a*) is a plan view of the latch 4 of the draw-in unit 6.
Figure 9B:
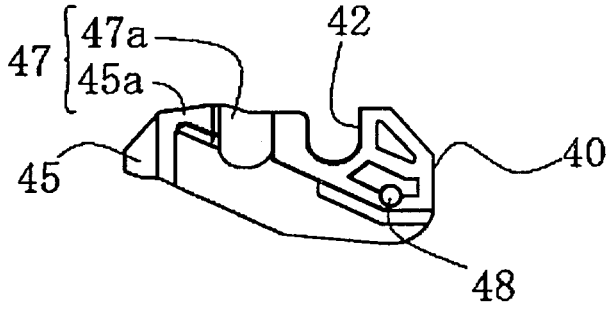
Figure 9C:
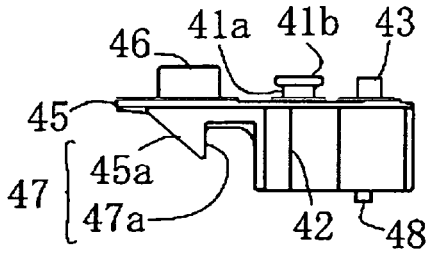
Figure 10A:
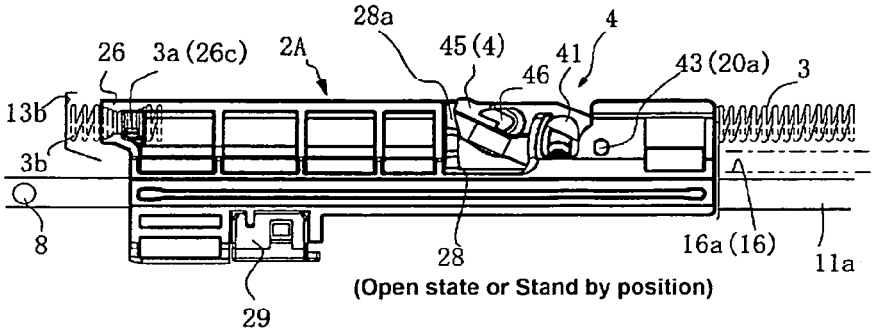
FIG. 10(*a*) is a schematic view showing the latch 4 and a surrounding portion thereof when the latch 4 is in the standby position.
Figure 10B:
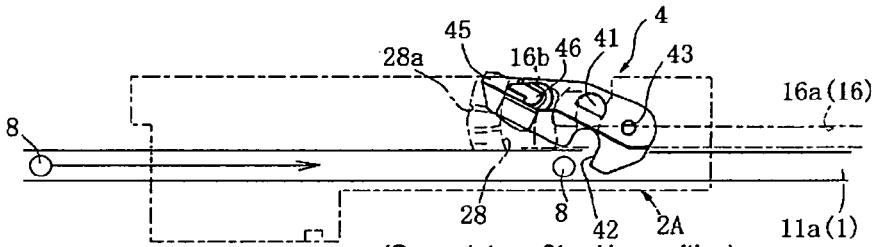
Figure 10C:
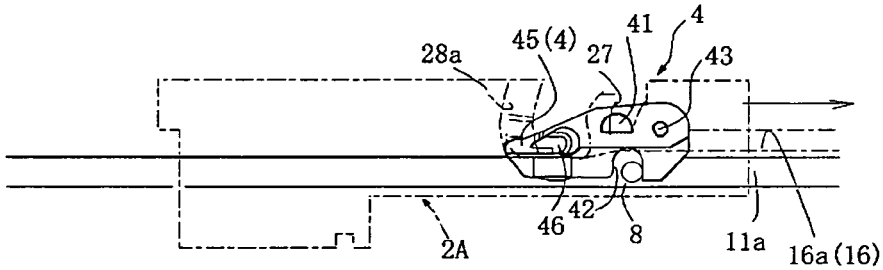
Figure 10D:
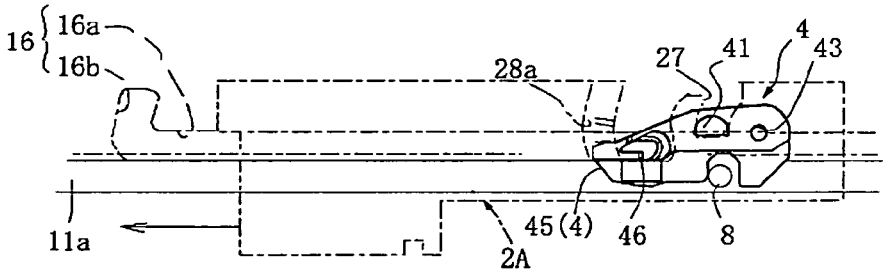

Also, as shown in FIG. 1(*a*), the latch 4 used for the slider 2A and the latch 4 used for the slider 2B are bilaterally symmetric mutually. Also, as shown in FIGS. 9(*a*) to 9(*c*), the latch 4 is a resin molded body with a thickness size which can easily fit in the latch placement portions 20 and 30, and integrally forms a support portion 40 pivotally supporting to sliders 2A and 2B sides; an engaging portion 42 provided on one side of the support portion 40, and engaging with/disengaging from the projecting body 8, which is the actuating member, at a normal time; and an assist engaging device 47 located on a lower surface side of the latch 4, and provided on an end portion 45 side rather than the engaging portion 42.

Figure 3A:
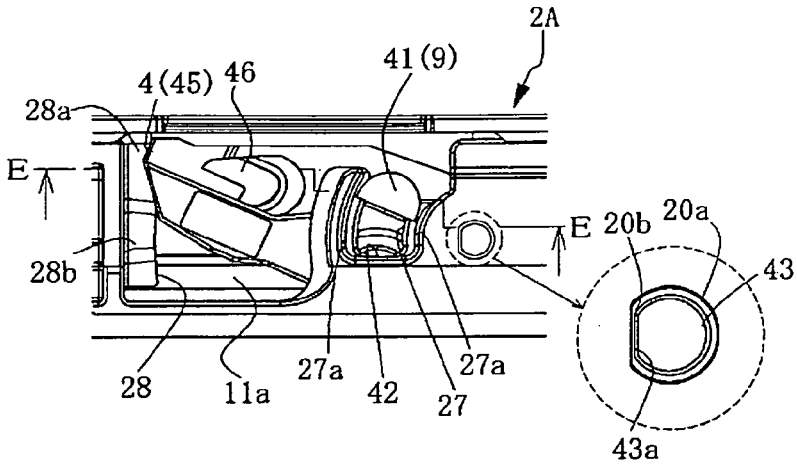
FIG. 3(*a*) is a schematic view wherein an inside of a frame shown by assigning the reference alphabet "D" in FIG. 1(*a*) is enlarged, and shows a standby position of a latch 4.
Figure 3B:
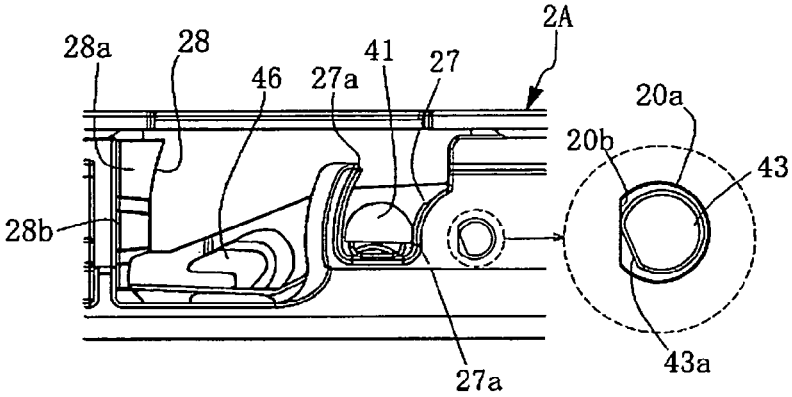
Figure 3C:
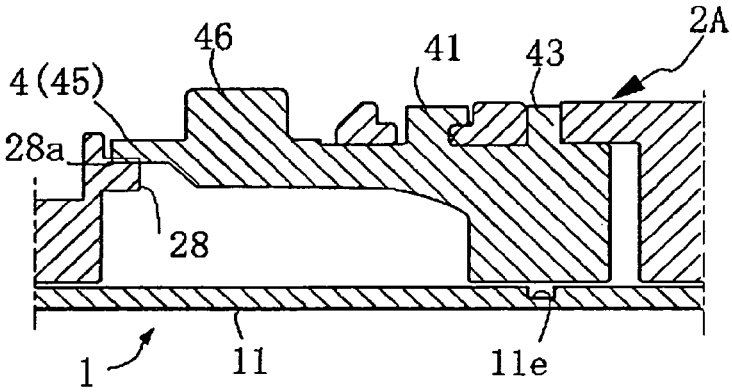

The support portion 40 includes a pivotally supporting axis portion 43 located on an upper surface side, and provided to protrude on an end portion side; a suspending support axis 41 provided to protrude near the center; and the tracing protrusion 46 provided to protrude on an end side which is separated from the axis portion 43. Among the above, in the axis portion 43, there is formed a flat surface portion 43*a* along an axis direction, so that an outer shape of a cross section of the axis portion 43 is not a complete circular form, and includes an arc portion and a straight portion. Thereby, to explain an engaging structure between the slider 2A and the latch 4 as an example, as shown in FIG. 3(*a*), when the axis portion 43 of the latch 4 is fitted into the axis hole 20*a* of the slider 2A in such a way that the positional control surface 20*b* of the axis hole 20*a* in the slider 2A and the flat surface portion 43*a* of the axis portion 43 in the latch 4 are facing each other approximately in parallel, the latch 4 becomes a stable fitted state wherein the latch 4 is most difficult to turn relative to the slider 2A. Then, as shown in FIG. 3(*b*), when the axis portion 43 of the latch 4 is turned from the aforementioned fitted state, the axis portion 43 deviates for a predetermined angle from a state wherein the positional control surface 20*b* of an axis hole 20*a* side and the flat surface 43*a* face approximately in parallel as mentioned above. Incidentally, the fitting between the axis hole 30*a* of the slider 2B and the axis portion 43 of the latch 4 is also approximately the same as the fitted state between the slider 2A and the latch 4.

However, in the present example, although the embodiment, wherein both the cross-sectional shape of the axis portion 43 of the latch 4 and the cross-sectional shape of the axis holes 20*a* and 30*a* of the sliders 2A and 2B have a D cut, is shown, the above-mentioned cross-sectional shapes may have, for example, an H cut. Namely, in the standby position of the latch 4 shown in FIG. 3(*a*), the structure may be that the positional control surface 20*b* and the flat surface 43*a* of the axis holes 20*a* and 30*a* in the sliders 2A and 2B become the fitted state of facing approximately in parallel, so that the tracing protrusion 46 becomes difficult to deviate from the locking groove 16*b*, and also that when the latch 4 is switched to the draw-in position of FIG. 3(*b*) from the standby position (when the tracing protrusion 46 enters into the straight groove 16*a* from the aforementioned locking groove 16*b*), accompanied by the aforementioned fitted state that is released, a large resistance force acts. The cross-sectional shape of the axis portion 43 of the latch 4 and the cross-sectional shape of the axis holes 20*a* and 30*a* of the sliders 2A and 2B have the shape as mentioned above so as to be capable of reducing an abnormal noise which can easily occur when the latch 4 is switched to the draw-in position from the standby position.

The support axis 41 includes a neck portion 41*a* slidably inserted and passed through the support groove 27 or 37, and the head portion 41*b* forming the diameter larger than that of the neck portion 41*a* around a top of the neck portion. The head portion 41*b* structures the control device 9 together with the support groove 27 or 37, and retains the neck portion 41*a* in a state being inserted and passed through the support groove 27 or 37.

The protrusion 46 is formed higher than the axis portion 43 and the support axis 41, and in a state wherein the latch 4 is pivotally supported rotatably in each slider 2A and 2B, the latch 4 fits into the guide portion 16 on the cover side, slides along the straight groove 16*a*, and engages with the locking groove 16*b* so as to lock sliding of the latch 4 (and the sliders 2A and 2B).

The assist engaging device 47 engages with the projecting body 8 when the latch 4 has come to the draw-in position by a mis-actuation so as to be capable of switching the latch 4 from the draw-in position to the standby position. In the example, the assist engaging device 47 has a step-like shape whose end side is widely depressed on the lower surface side of the latch 4, and is structured by a slope-face guide portion 45*a* on an end side which guides the projecting body 8, and a concave portion 47*a* continuous with the slope-face guide portion 45*a*, and deepening one step. The slope-face guide portion 45*a* is a taper which lowers as the slope-face guide portion 45*a* goes to the end. In a used aspect, when the projecting body 8 abuts upward against the slope-face guide portion 45*a*, the projecting body 8 slides while reducing a protruding amount, and when the projecting body 8 enters into the concave portion 47*a*, the projecting body 8 increases the protruding amount again so as to maintain an engagement with the concave portion 47*a*.

In the present example, the coil spring 3 is a compression coil spring. In a position deviated slightly toward the center rather than end surfaces of both right and left ends in the coil spring 3, there are formed the small diameter end portions 3*a* in which a diameter of a cross-section is narrowed down smaller than a center portion of the coil spring 3. On end surface sides rather than the small diameter end portions 3*a*, there are provided the elongation portions 3*b* having an approximately equal diameter of the cross-section to that of the center portion of the coil spring 3. The elongation portions 3*b* act as a buffering portion in the present invention, and a coil wind is formed more roughly than the small diameter end portions 3*a*.

As for the braking device 5, the piston-type damper is used. The piston-type damper may be a publicly known piston-type damper (for example, see Japanese Unexamined Patent Publication No. 2006-29564 and the like), and may have a structure of including the cylinder 50, and a piston rod 51 gently protruding and entering with respect to the cylinder 50; of gently driving relative to the cylinder 50 wherein the piston rod 51 is fixed; or of gently driving relative to the piston rod wherein the cylinder 50 is fixed. Also, the cylinder 50 includes a neck-like locking groove 50*a* on an outer circumference of a back end, and the piston rod 51 includes a neck-like locking groove 51*a* on an outer circumference of a front end.

(Actuating Member)

The protruding body 8 is one example of the actuating member in the present invention, and has a structure freely protruding and entering with respect to the door A, which is one example of the mobile body, through the urging force, i.e., the structure of reducing the protruding amount against the urging force when the protruding body 8 receives a load. The present example is described in Japanese Unexamined Patent Publication No. 2011-001781 which is a prior application of the present applicants, and includes a case 8*a* attached to an upper end portion of the door A; a guide axis 8*b* protruding on the case 8*a* and guiding the door A along a guide rail on a stationary side; an adjustment member 8*d* disposed in a transverse hole 8*c* provided in the case 8*a*, and allowing a turning operation from an outside as an adjusting mechanism which adjusts a movement of the guide axis 8*b* in a width direction of the case 8*a*; an adjusting member which is not shown in the figures, and proceeds and recedes inside the case 8*a* by turning of the adjustment member 8*d* so as to adjust the movement of the guide axis 8*b* in the width direction; and the like. Naturally, the projecting body 8 is not limited to the above, and the projecting body 8 may have a guide axis structure which is disclosed in, for example, Japanese Unexamined Patent Publication No. 2007-107301, or a structure similar to the above.

(Assembly)

For example, each above-mentioned member is assembled as follows. Namely, first, after each latch 4 is pivotally supported in the sliders 2A and 2B, both the sliders 2A and 2B are connected through the piston-type damper, which is the braking device 5, and the coil spring 3. Next, the above members are assembled to the case 1, and the cover 15 is attached to the case 1 so as to become the draw-in unit 6.

In the draw-in unit 6, each latch 4 is rotatably supported relative to the sliders 2A and 2B by fitting of the axis portion 43 and the axis hole 20*a*, or of the axis portion 43 and the axis hole 30*a*. In that support state, the support axis is supported in a suspending state relative to the step difference 27*a* of the arc-like support groove 27, or to the step difference 37*a* of the support groove 37; the protrusion 46 protrudes to an upper side of the sliders 2A and 2B by passing through the escape groove 28 or the escape groove 38; and the end portion 45 is supported so as to be received in a flange-like receiving portion 28*a* or a receiving portion 38*a* provided on an inner side edge of the escape groove.

After that, the slider 2A and the slider 2B are mutually connected through the piston-type damper which is the braking device 5. In that case, in a state wherein the end of the piston rod 51 is inserted into the housing portion 21*d* from the window 21*c* relative to the connecting portion 21 of the slider 2A, as shown in FIG. 7(*b*), a fixing ring 52, which is a temporary fixing member, engages with the locking groove 51*a* on the outer circumference of the rod front end, so that the piston rod 51 is temporarily fixed into the housing portion 21*d* of the connecting portion 21 through the fixing ring 52. Also, the attachment member 29 is placed relative to the connecting portion 21 by engagements between the upper and lower claws 21*a* and the engaging holes 29*a*, and engagements between the protrusions 21*b* and the concave portions 29*b*, so that the piston rod 51 is firmly fixed from a temporary fixed state, and the position is reliably fixed. Only by matching the locking groove 50*a* on the aforementioned cylinder side to the gap 34*b* and by pressing, the cylinder 50 is engaged with and is connected to the clamp portion 34*a* relative to the connecting portion 31 of the slider 2B.

Also, the coil spring 3 is locked and fixed relative to the engaging portions 26 and 36, wherein the small diameter end portions 3*a* on both sides correspond, by a pressing operation relative to the sliders 2A and 2B. In that state, each elongation portion 3*b* protrudes only for a predetermined size more than a corresponding end of the sliders.

As mentioned above, the latch 4 and the sliders 2A and 2B pivotally supporting the latch 4 are disposed relative to the case 1 together with the braking device 5 and the coil spring 3. In the example, as a guide device between the sliders 2A and 2B, and the case 1, the convex portions 23 or 33 on the lower surface of each slider 2A and 2B fit into the guide grooves 11*b* of the case 1; the rib 22 or 32 on the upper surface of each slider fits into the guide groove 19*b* of the cover 15; and lower surface portions structuring the engaging portions 26 and 36 of each slider 2A and 2B are slidably fitted into the guide groove 11*c*. Also, the protrusion 46 is fitted into the guide portion of the case 1 from the escape grooves 28 and 38 of the sliders 2A and 2B, and the latch 4 is switched between the draw-in position which is slid along the straight groove 16*a* accompanied by sliding of the sliders, and the standby position which enters into the locking groove 16*b* from the straight groove 16*a* and is locked. Incidentally, the convex portion 48 on the lower surface is consistently fitted into the guide groove lie on the lower surface of the case 1 so as to allow the latch 4 to stably follow even rapid sliding of the corresponding slider.

(Actuation)

Figure 11A:
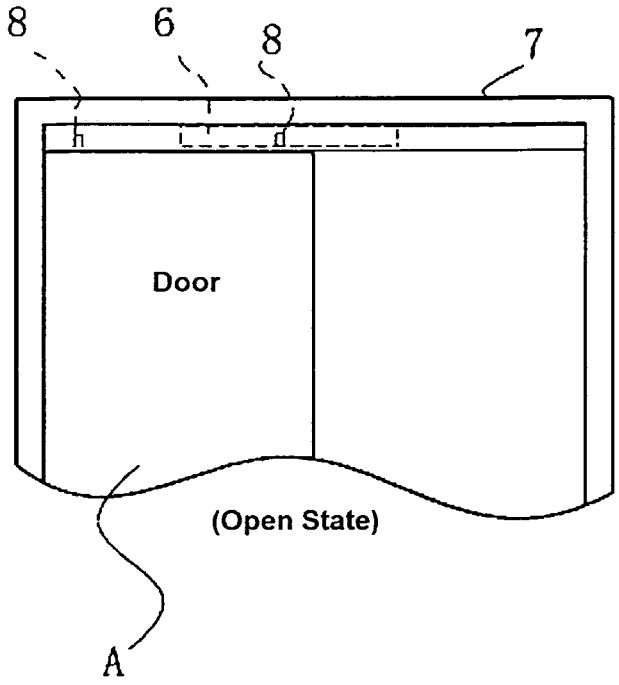
FIG. 11(*a*) is a drawing showing a state wherein the slide assist device according to the present embodiment is applied to a main body 7 and a sliding portion of a door A (a mobile body).
Figure 11B:
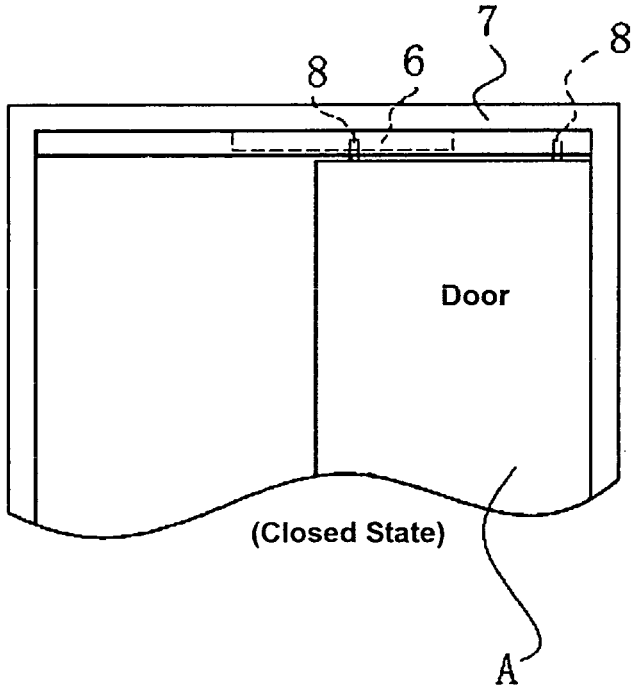
Figure 11C:
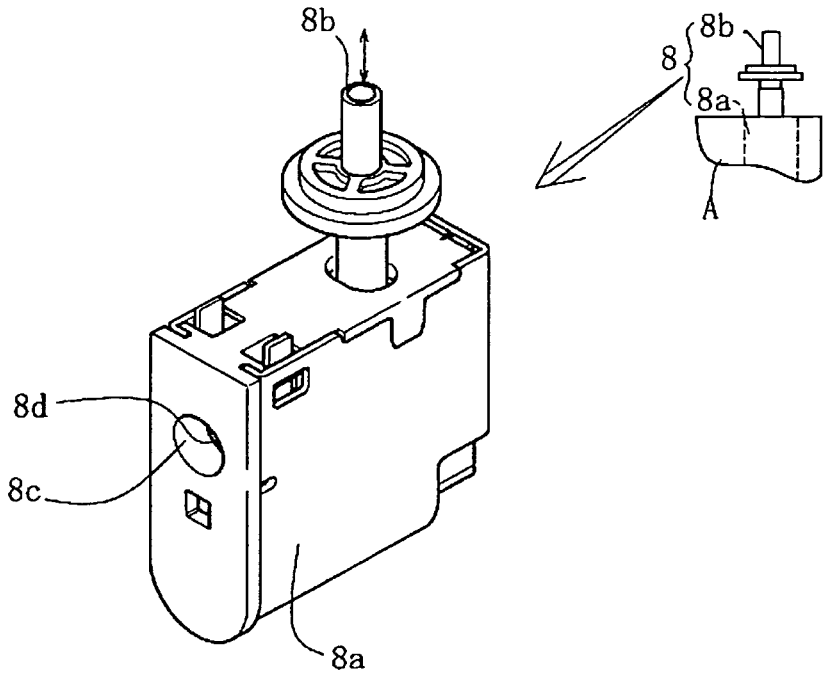
Figure 12A:
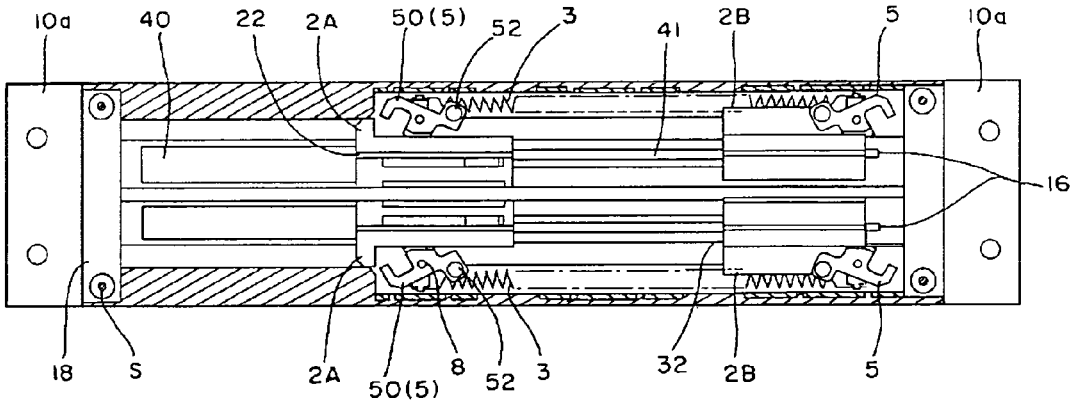
FIG. 12(a) Prior Art
FIG. 12(*a*) is a schematic structural view of a draw-in unit in a slide assist device of Patent Document 1.
Figure 12B:
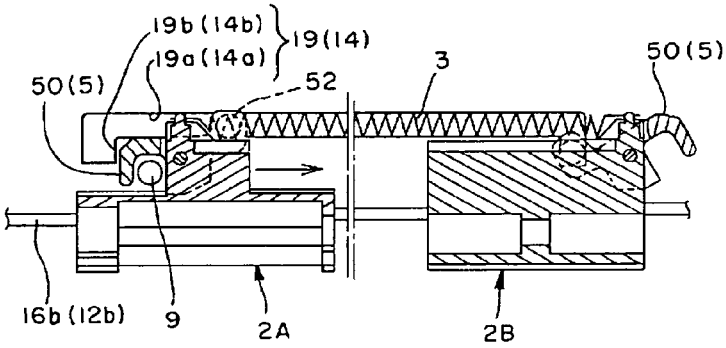
FIG. 12(b) Prior Art

Next, the actuation of essential parts in a case of being applied to the door A shown in FIGS. 11(*a*) and 11(*b*) will be explained.

(1) FIG. 10(*a*) shows a left side portion in the draw-in unit 6, i.e., the stand-by position (a state wherein the protrusion 46 on a latch side is engaged with the locking groove 16*b* of the guide portion 16 on the cover side) of the latch 4 on the slider 2A side together with the projecting body 8 which is the actuating member. FIG. 10(*b*) shows the same aspect as that of FIG. 10(*a*) by showing only the slider 2A with imaginary lines so that a relationship of the members can be easily understood. In the standby position of the latch 4, the coil spring 3 is stretched, and the urging force has been accumulated. Also, the elongation portion 3*b* on the left side abuts against the end portion 13*a* of the case 1. In the structure, in the standby position, there is an actuation characteristic as follows.

A) In a pivotally supporting structure of the latch 4, as shown in FIG. 3(*a*), the cross-sectional shape of the axis hole 20*a* has a shape in which one portion of a circular arc is notched in a linear fashion. Therefore, although most of the inner surface of the axis hole 20*a* has the approximately cylindrical form, there is provided the planar portion as the positional control surface 20*b* in one portion thereof. Also, the cross-sectional shape of the axis portion 43 has the shape in which one portion of the circular arc is notched in the linear fashion as well. Therefore, although most of an outer surface of the axis portion 43 has the approximately cylindrical form, there is provided the planar portion 43*a* in one portion thereof. Thereby, when the latch 4 is in the standby position, a fitted state between the axis portion 43 and the axis hole 20*a* becomes the most stable fitted state wherein the planar portion 43*a* of the axis portion 43 and the positional control surface 20*b* of the axis hole 20*a* face approximately in parallel. Then, when the latch 4 turns from the standby position, a boundary portion between the planar portion 43*a* in a side surface of the axis portion 43 and a curved surface portion, and the like abut against the inner surface of the axis hole 20*a* so as to receive the resistance. Accordingly, the axis portion 43 is difficult to turn. Therefore, the latch 4 can be prevented from turning by a vibration, an impact, and the like from an outside.

B) In the aforementioned control device 9, the large diameter head portion 41*b* on a support axis side is received by the step difference 27*a* of the support groove 27, or the step difference 37*a* of the support groove 37 so as to reliably maintain a normal position of the latch 4 relative to the sliders 2A and 2B.

C) Also, in the pivotally supporting structure, due to a resistance increasing action of the aforementioned resistance-imparting portion 28*b*, improper turning of the latch 4 due to the vibration, the impact, and the like can be reliably prevented, thereby being capable of preventing the mis-actuation.

D) Moreover, in the pivotally supporting structure, in the standby position of the latch 4, in the slider 2A pivotally supporting the latch 4, the elongation portion 3*b* of the urging device 3 abuts against the end portion 13*a* dividing the case space portion 10, so that even if the slider 2A receives the vibration or the impact, the elongation portion 3*b* is difficult to be affected due to a vibration- or impact-absorptive action.

(2) FIG. 10(*c*) shows a state wherein the latch has been switched to the draw-in position. In the positional switchover of the latch 4, when the latch 4 is in the standby position as shown in FIG. 10(*b*), the door A has been moved in a right direction (a closing direction) from the left in FIG. 11(*a*), and the projecting body 8 of the door hits against a corresponding portion of the engaging portion 42. Then, the latch 4 is rotated counterclockwise at a supporting point of the axis portion 43 by stress thereof, and the protrusion 46 is unlocked from the locking groove 16*b* so as to fit into the straight groove 16*a*, and the latch 4 is switched to the draw-in position wherein the projecting body 8 has been engaged with the engaging portion 42. Then, the slider 2A is drawn into the slider 2B side by the urging force of the urging device 3 together with the latch 4 so as to switch the door to a closed position. In that case, in the embodiment, when the door A is moved by the urging force of the urging device 3, the door receives braking of the aforementioned braking device 5 so as to be gently slid. In the structure, in the above-mentioned positional switchover, there is an actuation characteristic as follows.

E) In the structure, when the latch 4 is rotated counterclockwise at the supporting point of a pivotal support portion, since as the control device 9, the support axis 41 is slid in a state of being received by the step difference 27*a* of the support groove 27 on the slider side, or due to a structure in which the end portion 45 of the latch 4 is received by the receiving portion 28*a* or 38*a* on an escape groove side, the structure prevents the latch 4 from tilting relative to the slider 2A and maintains a horizontal rotation movement so as to be capable of reliably resolving a possibility of the mis-actuation.

F) In the pivotally supporting structure of the latch 4, due to the shape of the above-mentioned D cut or the H cut, the latch is turned at a slow speed so as to be capable of reducing a switchover sound which occurs when the latch 4 is switched to the draw-in position from the standby position through the projecting body 8 which is the actuating member.

(3) FIG. 10(*d*) assumes a state wherein the door A has been operated to slide in an open direction from the closed position. In that process, when the door is operated to move in a left direction from the right in the same figure, the slider 2A is slid to a left side through the projecting body 8 engaged with the engaging portion 42 of the latch 4 which is in the drawn-in position. When the door is moved to the left further, and reaches the locking groove 16*b* on the left side as in the case of FIG. 10(*b*), while the latch 4 is rotating clockwise at the supporting point of the axis portion 43 by the stress caused when the projecting body 8 comes out of the engaging portion 42, the protrusion 46 engages with the locking groove 14*b* from the straight groove 14*a* so as to be switched to the standby position. Incidentally, in that process, the urging force is accumulated in the urging device 3. That state is maintained as long as the latch 4 is in the standby position.

In the above-mentioned positional switchover, in the structure, in such a case where the door is operated to slide rapidly and accompanied by that, the slider 2A is also slid at high speed, the elongation portion 3*b* abuts against the corresponding end portion 13*a* on the case side, and due to the impact-absorptive action of the elongation portion 3*b*, the impact applied to the slider 2A is buffered so as to be capable of preventing the possibility of the mis-actuation (the protrusion 46 moves from the locking groove 16*b* to the straight groove 16*a*) of the latch 4.

As mentioned above, although the present invention is explained using the embodiment thereof, a technical scope of the present invention is not limited to a scope described in the aforementioned embodiment. It is obvious that a person skilled in the art can make various changes or improvements to the aforementioned embodiment.

EXPLANATION OF SYMBOLS

1 . . . a case (10 is an internal space, 11 is a lower surface, 12 is side surfaces, 13 and 13*a* are end portions, and 15 is a cover.)

2A . . . a slider (20 is a latch placement portion, 21 is a connecting portion, 22 is a rib, and 23 is a convex portion.)

2B . . . a slider (30 is a latch placement portion, 32 is a rib, and 33 is a convex portion.)

3 . . . a coil spring (an urging device) (3*a* is a small diameter end portion, and 3*b* is a buffering elongation portion.)

4 . . . a latch (40 is a support portion, 41 is a support axis, 42 is an engaging portion, and 46 is a protrusion.)

5 . . . a braking device (50 is a cylinder, and 51 is a piston rod.)

6 . . . a draw-in unit

7 . . . a main body

8 . . . a projecting body (an actuating member)

9 . . . a control device

10 . . . a guide portion (16*a* is a straight groove, and 16*b* is a locking groove.)

20*a* . . . an axis hole (20*b* is a positional control surface.)

28 and 38 . . . escape grooves (28*a* and 38*a* are step differences, and 28*b* is a resistance-imparting portion.)

29 . . . an attachment member (29*a* is an engaging hole, and 29*b* is a concave portion.)

43 . . . an axis portion (43*a* is a flat surface.)

A . . . a door (a mobile body)

What is claimed is:

1. A slide assist device, comprising:

a draw-in unit including:

a case adapted to attach to one of a main body or a mobile body, a slider slidably placed on the case, a latch pivotally supported in the slider and capable of switching between a standby position in which the latch is locked in a corresponding portion of the case and a draw-in position in which the latch is released from the case, and an urging device connected to the slider and arranged to accumulate an urging force thereof, and an actuating member adapted to attach to the other of the main body or the mobile body, and arranged to be able to engage with the latch so that the latch is switched from the standby position to the draw-in position, or to be able to disengage from the latch so that the latch is switched from the draw-in position to the standby position, wherein when the latch is switched from the standby position to the draw-in position, the urging force accumulated in the urging device moves the mobile body from a first position on a main body side to a second position through the actuating member, wherein the latch includes an axis portion having a D-shape including a circular portion and a flat surface along an axis direction, and the slider includes an axis hole to rotatably fit the axis portion, and the axis hole having a D-shape including a circular portion corresponding to the circular portion of the axis portion and a positional control surface corresponding to the flat surface, and the draw-in unit is arranged so that when the latch is switched to the standby position, the flat surface of the axis portion and the positional control surface of the axis hole face each other, and when the latch is switched to the draw-in position, the flat surface of the axis portion abuts the positional control surface of the axis hole and prevents the axis portion from further rotation.

2. A slide assist device, comprising:

a draw-in unit including:

a case adapted to attach to one of a main body or a mobile body, a slider slidably placed on the case, a latch pivotally supported in the slider and capable of switching between a standby position in which the latch is locked in a corresponding portion of the case and a draw-in position in which the latch is released from the case, a resistance-imparting portion provided on a sliding-and-contacting surface of the slider or the latch in which the sliding-contacting surface is a surface between the latch and the slider, and acting as a resistance or a friction force when the latch is turned as a supporting point of a pivot portion relative to the slider, and an urging device connected to the slider and arranged to accumulate an urging force thereof; and an actuating member adapted to attach to the other of the main body or the mobile body, and arranged to be able to engage with the latch so that the latch is switched from the standby position to the draw-in position, or to be able to disengage from the latch so that the latch is switched from the draw-in position to the standby position, wherein when the latch is switched from the standby position to the draw-in position, the urging force accumulated in the urging device moves the mobile body from a first position on a main body side to a second position through the actuating member, and the resistance-imparting portion has a concave-convex shape in which a convex portion of the resistance-imparting portion is positioned in the middle of a rotating direction of the pivot portion, and in which a concave portion is disposed on the opposite side of the convex portion.

3. A slide assist device, comprising:

a draw-in unit including:

a case adapted to attach to one of a main body or a mobile body, a slider slidably placed on the case, a latch pivotally supported in the slider and capable of switching between a standby position in which the latch is locked in a corresponding portion of the case and a draw-in position in which the latch is released from the case, and an urging device connected to the slider and arranged to accumulate an urging force thereof, an actuating member adapted to attach to the other of the main body or the mobile body, and arranged to be able to engage with the latch so that the latch is switched from the standby position to the draw-in position, or to be able to disengage from the latch so that the latch is switched from the draw-in position to the standby position, a piston braking device comprising a structural member, for damping a moving speed by an urging force of the mobile body, a fixing ring as a temporary fixing member arranged in the slider or the case to temporarily fix the structural member of the braking device, and an attachment member to be attached to the slider or the case to firmly fix the structural member of the braking device to the slider or the case, wherein when the latch is switched from the standby position to the draw-in position, the urging force accumulated in the urging device moves the mobile body from a first position on a main body side to a second position through the actuating member, and the draw-in unit includes a connecting portion to hold the attachment member, and the fixing ring is disposed inside the connecting portion, so that the fixing ring is arranged to temporarily fix the structural member of the braking device to the draw-in unit and the attachment member is placed over the connecting portion to firmly fix the structural member and engage with the connecting portion.

4. A slide assist device according to claim 2, wherein the convex portion is disposed on the slider to stably hold the latch in the standby position when the latch is rotated.

5. A slide assist device according to claim 4, wherein the latch has an end portion having a flat surface to contact the convex or concave portion.

6. A slide assist device according to claim 2, wherein the convex portion is disposed on a lower surface of an end of the latch.

7. A slide assist device according to claim 2, further comprising a cover disposed over the case, wherein the cover has a guide portion including a straight groove extending in a longitudinal direction of the draw-in unit and a locking groove having an L-shape on two ends of the straight groove, and the guide portion is arranged to fit the latch, and the latch slides along the straight groove and engages with the locking groove to lock the latch.

8. A slide assist device according to claim 2, wherein the latch further comprises an assist engaging device to engage with the actuating member when the latch is in the draw-in position by a mis-actuation so as to be capable of switching the latch from the draw-in position to the standby position.

9. A slide assist device according to claim 3, wherein the structural member is a piston rod having a locking groove on an outer circumference at one end thereof to engage with the fixing ring, the connecting portion further comprises a housing portion to house the fixing ring attached to the one end of the piston rod to fix the piston rod to the draw-in unit, and the attachment portion is arranged to detachably attach to the connection portion so that when the piston rod is temporarily fixed in the housing portion through the fixing ring, the attachment portion is placed over the housing portion to fix the braking device to the draw-in unit.

* * * * *